US008840091B1

(12) United States Patent
Laurita

(10) Patent No.: US 8,840,091 B1
(45) Date of Patent: Sep. 23, 2014

(54) METHOD AND APPARATUS FOR ATTACHING BRACKETS TO RAILINGS

(71) Applicant: Joseph N. Laurita, Wayne, NJ (US)

(72) Inventor: Joseph N. Laurita, Wayne, NJ (US)

( * ) Notice: Subject to any disclaimer, the term of this patent is extended or adjusted under 35 U.S.C. 154(b) by 0 days.

(21) Appl. No.: 14/230,819

(22) Filed: Mar. 31, 2014

(51) Int. Cl.
*E04H 17/00* (2006.01)
*E04F 11/18* (2006.01)

(52) U.S. Cl.
CPC ..... *E04F 11/1804* (2013.01)
USPC ..... 256/65.04; 52/183; 256/68; 256/69; 256/65.03; 256/65.06

(58) Field of Classification Search
USPC ..... 52/182, 183; 256/67, 68, 69, 70, 65.02, 256/65.03, 65.04, 65.05, 65.06, 65.07, 256/65.08, 19, 21, 22
See application file for complete search history.

(56) References Cited

U.S. PATENT DOCUMENTS

| | | | | |
|---|---|---|---|---|
| 2,754,092 | A * | 7/1956 | Cremens | 256/21 |
| 3,164,354 | A * | 1/1965 | Murdock | 248/251 |
| 3,756,567 | A * | 9/1973 | Murdock | 256/21 |
| 3,942,763 | A * | 3/1976 | Helterbrand et al. | 256/22 |
| 6,039,307 | A * | 3/2000 | De Zen | 256/19 |
| 6,893,008 | B2 * | 5/2005 | Forbis | 256/65.05 |
| 6,948,704 | B2 * | 9/2005 | Forbis et al. | 256/65.08 |
| 7,147,212 | B2 * | 12/2006 | Platt | 256/67 |

* cited by examiner

*Primary Examiner* — Chi Q Nguyen
(74) *Attorney, Agent, or Firm* — Walter J. Tencza, Jr.

(57) ABSTRACT

An apparatus comprising a bracket, and a device for connecting to the bracket. The bracket may be one of a plurality of brackets for placing a plant box on. The device may have a first portion having an opening through which a fastener can be inserted to connect the device to the bracket. The device may have a second portion connected at an angle to the first portion. The device may be sized so that when connected to the bracket by inserting the fastener through the opening, the second portion of the device fits snugly within opposing sections of the bracket, such that the second portion has a length which is slightly less than a distance between the opposing sections of the bracket. The apparatus may further include a railing situated so that a cross section of the railing sits in between a space between the device and the bracket.

10 Claims, 17 Drawing Sheets

METHOD AND APPARATUS FOR ATTACHING BRACKETS TO RAILINGS

FIELD OF THE INVENTION

This invention relates to improved methods and apparatus concerning attaching brackets to railings.

BACKGROUND OF THE INVENTION

There are various devices known in the prior art for attaching brackets to railings.

SUMMARY OF THE INVENTION

One or more embodiments of the present invention provide an apparatus comprising a bracket; and a device for connecting to the bracket. The bracket may be one of a plurality of brackets for placing a plant box on. The device may have a first portion having an opening through which a fastener can be inserted to connect the device to the bracket. The device may have a second portion which is connected to the first portion, so that the second portion is at an angle to the first portion. The device may be sized so that when connected to the bracket by inserting the fastener through the opening, the second portion of the device fits snugly within opposing sections of the bracket, such that the second portion has a length which is slightly less than a distance between the opposing sections of the bracket.

The apparatus may further include a railing situated so that a cross section of the railing sits in between a space between the device and the bracket. The device may have a third portion which is fixed substantially perpendicularly to the second portion. An underside of the railing may contact the second portion and the third portion of the device. The device may have a fourth portion which is fixed substantially perpendicularly to the second portion at a distance from the third portion. An underside of the railing may contact the second portion, the third portion, and the fourth portion of the device.

The third portion may have a height and the fourth portion may have a height, and the height of the third portion may differ from the height of the fourth portion. The bracket may be made substantially of metal; and the device may be substantially made of plastic.

One or more embodiments of the present invention may also include a method comprising the steps of placing a bracket so that a portion of the bracket sits on a railing; and connecting a device to the bracket so that the bracket becomes mounted to the railing. The device may be as previously described.

DETAILED DESCRIPTION OF THE DRAWINGS

Figure 1A:
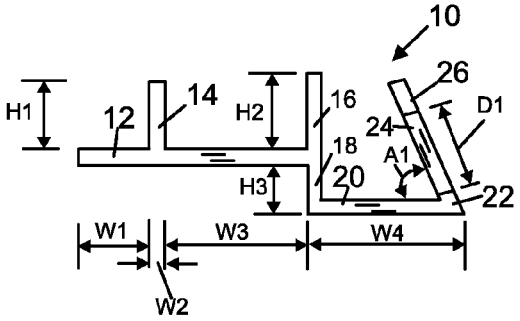
FIG. 1A shows a right side view of a first device in accordance with an embodiment of the present invention.
Figure 1B:
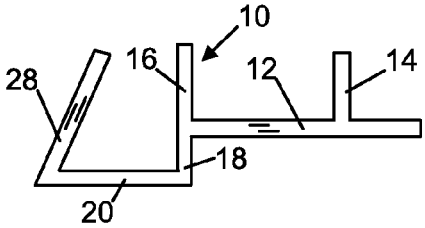
FIG. 1B shows a left side view of the first device of FIG. 1A.
Figure 1C:
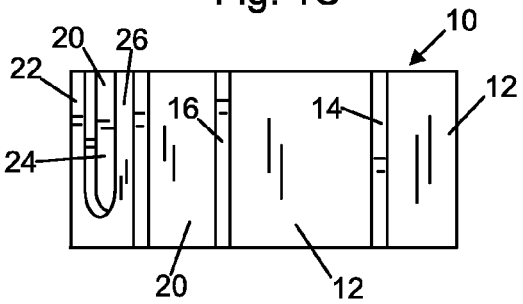
FIG. 1C shows a top view of the first device of FIG. 1A.
Figure 1D:
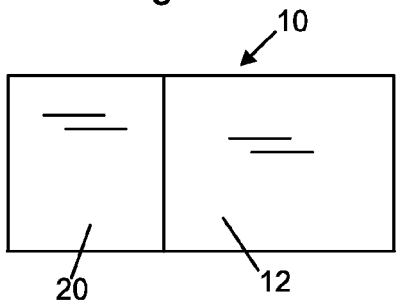
FIG. 1D shows a bottom view of the first device of FIG. 1A.
Figure 1E:
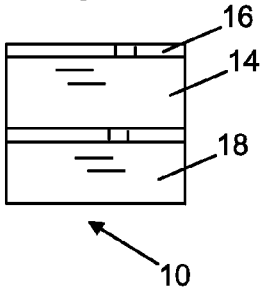
FIG. 1E shows a front view of the first device of FIG. 1A.
Figure 1F:
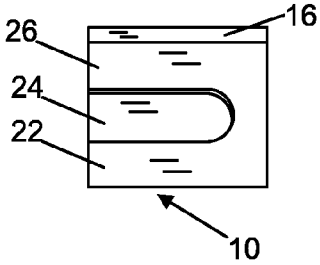
FIG. 1F shows a rear view of the first device of FIG. 1A.
Figure 10:
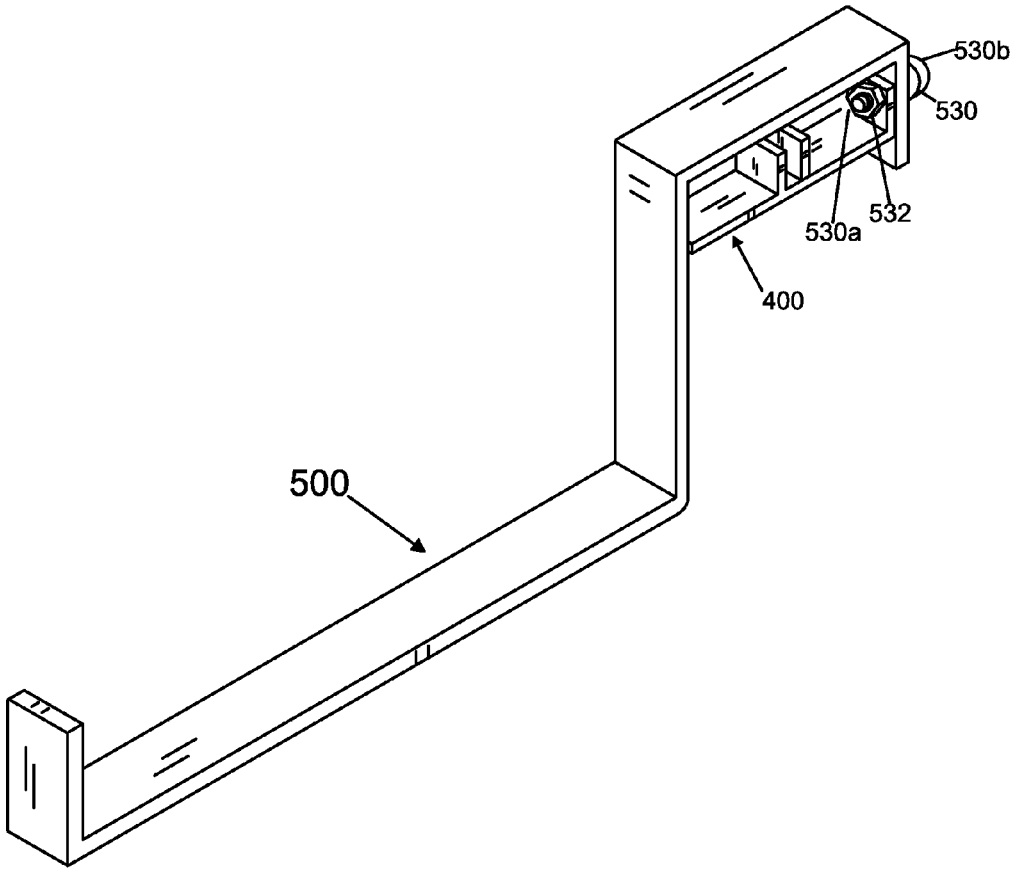
FIG. 10 shows a front, right side, and top perspective view of the third bracket along with the third device of FIG. 8A, and along with the third bolt or screw and the third nut, with the third bolt or screw and the third nut attaching the third device of FIG. 8A to the third bracket.

FIG. 1A shows a right side view of a first device 10 in accordance with an embodiment of the present invention. FIG. 1B shows a left side view of the first device 10. FIG. 10 shows a top view of the first device 10. FIG. 1D shows a bottom view of the first device 10. FIG. 1E shows a front view of the first device 10. FIG. 1F shows a rear view of the first device 10.

The first device 10 may be made of plastic. The first device 10 may include portions 12, 14, 16, 18, 20, 22, and 26. The first device 10 may include a gap or slot 24 between the portions 22 and 26 as shown in FIG. 10 and FIG. 1F. The first device 10 may include dimensions H1, H2, H3, D1, W1, W2, W3, and W4 shown in FIG. 1A which may be about three eighths of an inch, seven sixteenths of an inch, five sixteenths of inch, five sixteenths of an inch, half an inch, one eighth of an inch, three quarters of an inch, and seven eighths of an inch, respectively. The portions 22 and 26 may be at an angle A1 of about 60 degrees with respect to the portion 20.

Figure 2:
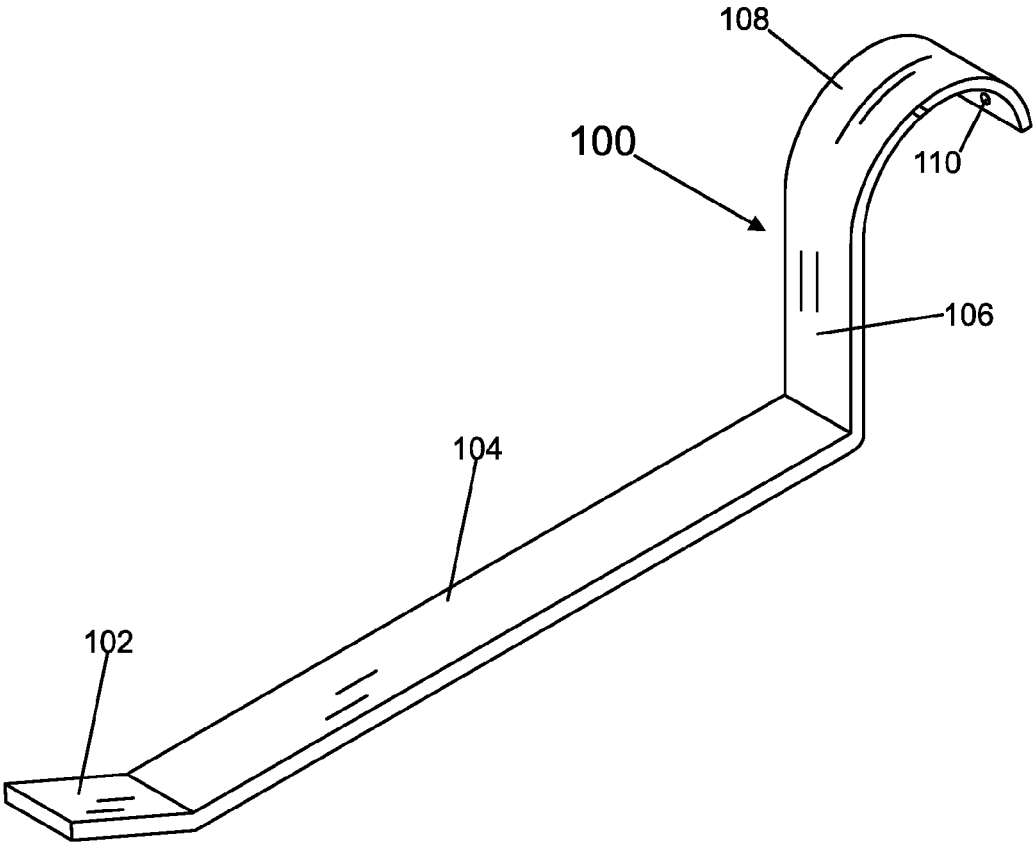
Fig. 2 (Prior Art)
FIG. 2 shows a front, right side, and top perspective view of a first known bracket.

FIG. 2 shows a front, right side, and top perspective view of a first known bracket 100. The first known bracket 100 includes a portion 102, a portion 104, a portion 106, and a portion 108. The first known bracket 100 may be made of metal and may be used for holding plants on portion 104, or boxes for plants. The first bracket 100 may also have an opening 110 which is typically used for fixing directly to a wooden railing, by a screw which is inserted into the wood. However, prior to embodiments of the present invention, there are not adequate ways of securely attaching the first bracket 100 to a metal railing.

Figure 3A:
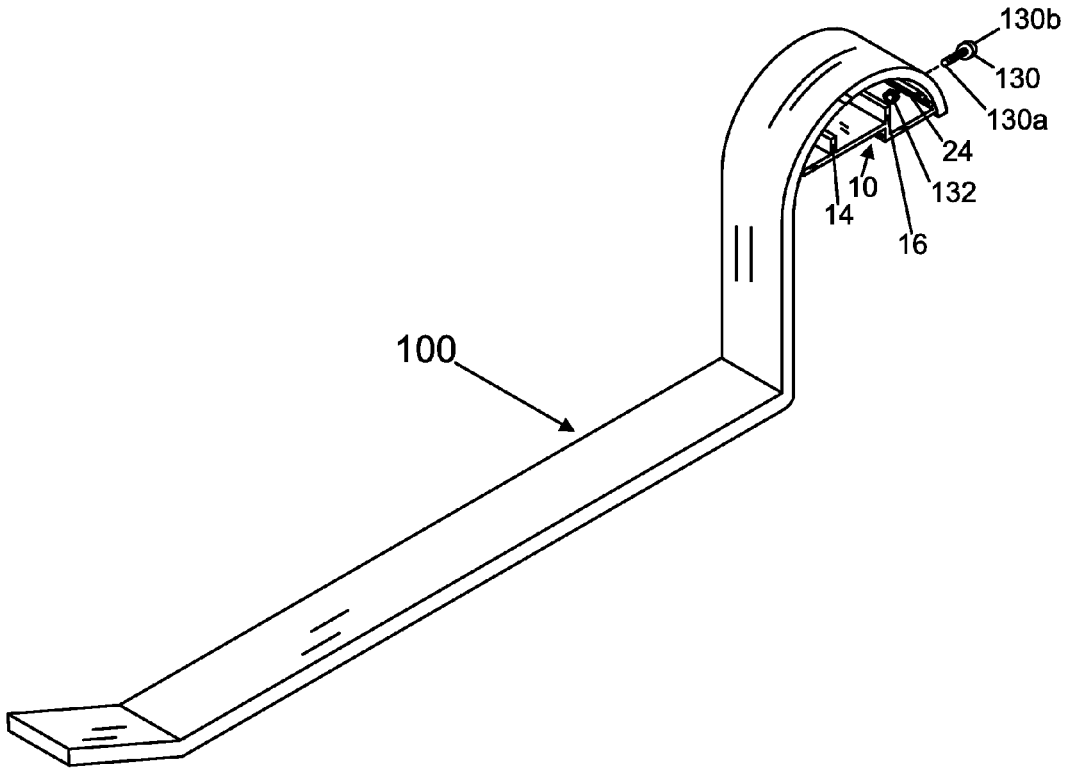
FIG. 3A shows a front, right side, and top perspective view of the first bracket of FIG. 2 along with the first device of FIG. 1A, and along with a first bolt or screw and a first nut, with the first bolt or screw and the first nut not attaching the first device of FIG. 1A to the first bracket.

FIG. 3A shows a front, right side, and top perspective view of the first bracket 100 along with the first device 10 and along with a first bolt or screw 130 and a first nut 132, with the first bolt or screw 130 and the first nut 132 not attaching the first device 10 of FIG. 1A to the first bracket 100. The first bolt 130 includes a top 130*b* and a bottom 130*a*.

Figure 3B:
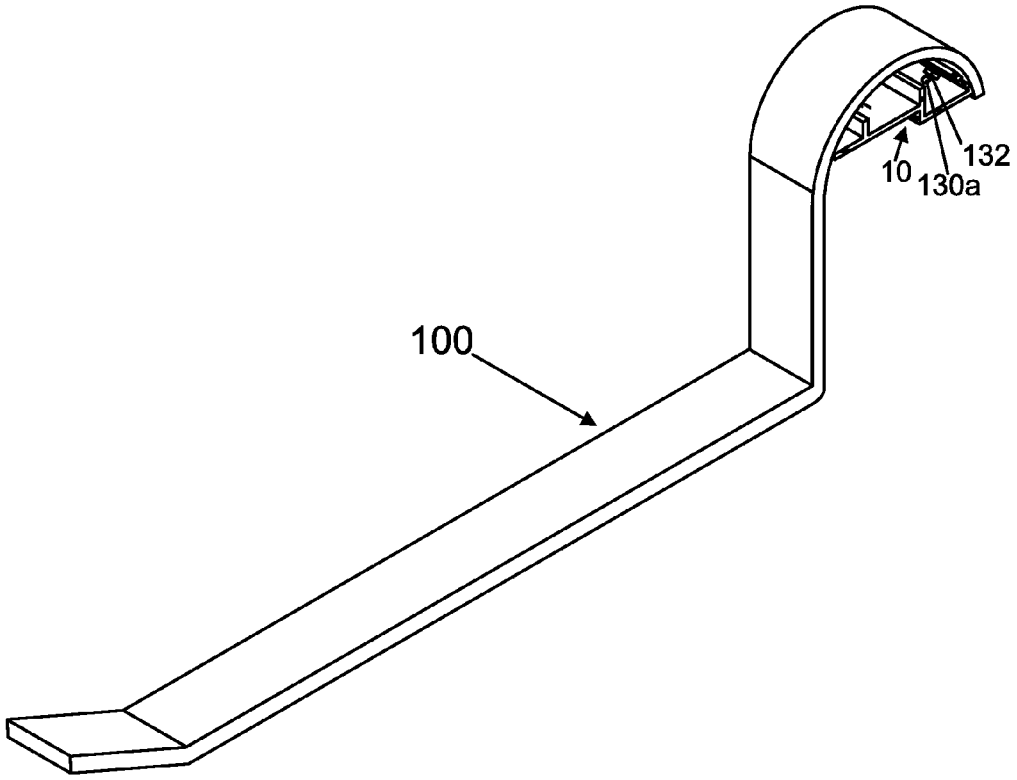
FIG. 3B shows a front, right side, and top perspective view of the first bracket of FIG. 2 along with the first device of FIG. 1A, and along with the first bolt or screw and the first nut, with the first bolt or screw and the first nut attaching the first device of FIG. 1A to the first bracket.

FIG. 3B shows a front, right side, and top perspective view of the first bracket 100 of FIG. 2 along with the first device 10 of FIG. 1A, and along with the first bolt or screw 130 and the first nut 132, with the first bolt or screw 130 and the first nut 132 attaching the first device 10 of FIG. 1A to the first bracket 100. The bottom 130*a* of the bolt 130 has been inserted through the opening 110 of the first bracket 100, and through the slot 24 of the first device 10, and the nut 132 has been threaded onto threads of the bolt 130, and tightened, to attach the first device 10 to the first bracket 100.

Figure 3C:
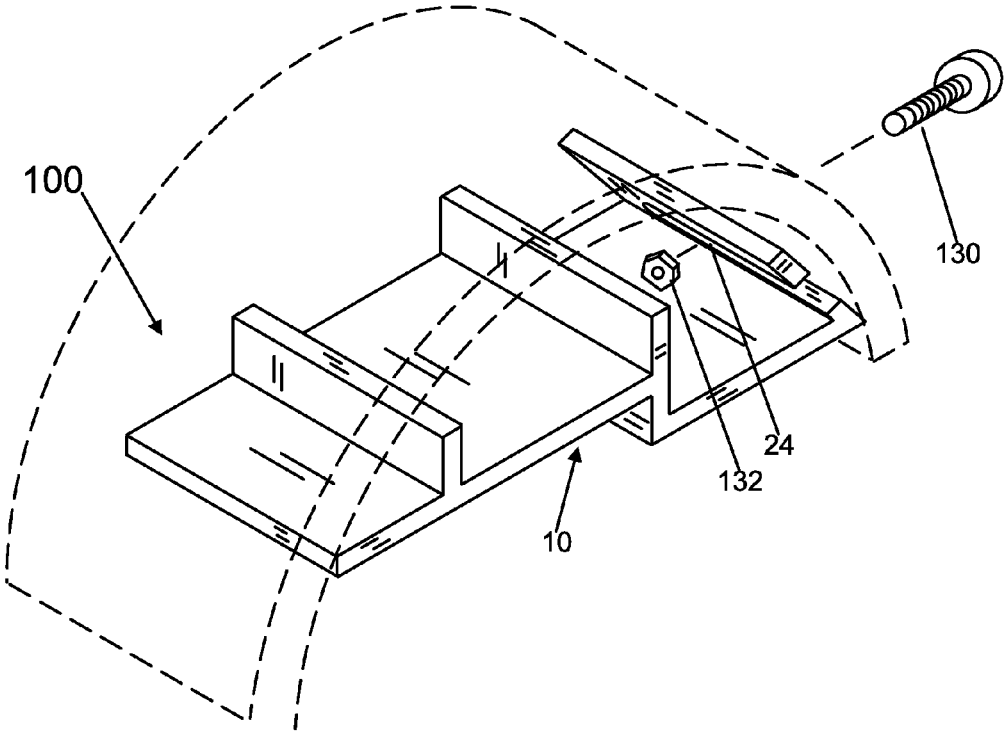
FIG. 3C shows a closeup view of part of the first bracket of FIG. 2, in dashed lines, the first device of FIG. 1A, the first bolt or screw, and the first nut, with the first device of FIG. 1A not attached to the first bracket by the first bolt and the first nut.

FIG. 3C shows a closeup view of part of the first bracket 100 of FIG. 2, in dashed lines, the first device 10 of FIG. 1A, the first bolt or screw 130, and the first nut 132, with the first device of FIG. 1A not attached to the first bracket 100 by the first bolt 130 and the first nut 132.

Figure 14:
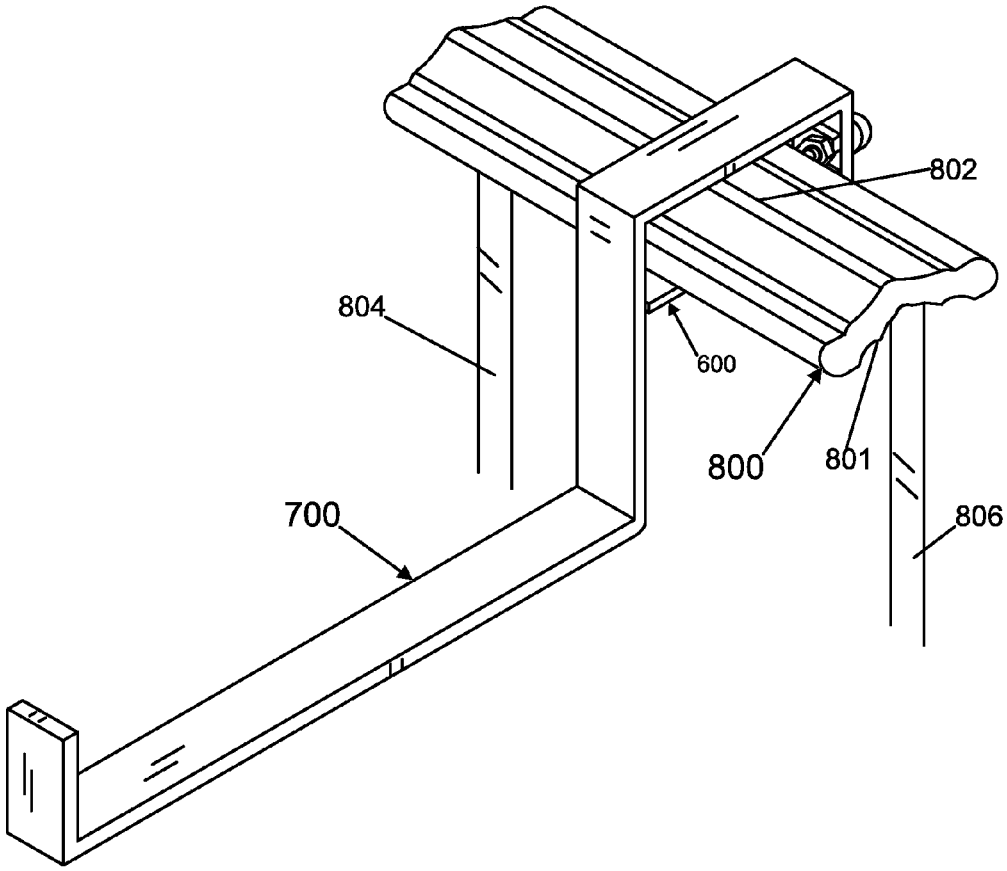
FIG. 14 shows a front, right side, and top perspective view of the fourth bracket along with the fourth device of FIG. 11A, and along with the fourth bolt or screw and the fourth nut, with the fourth bolt or screw and the fourth nut attaching the fourth device of FIG. 11A to the fourth bracket, and with the fourth bracket, fourth device, fourth bolt or screw, and fourth nut attached to a railing.
Figure 15:
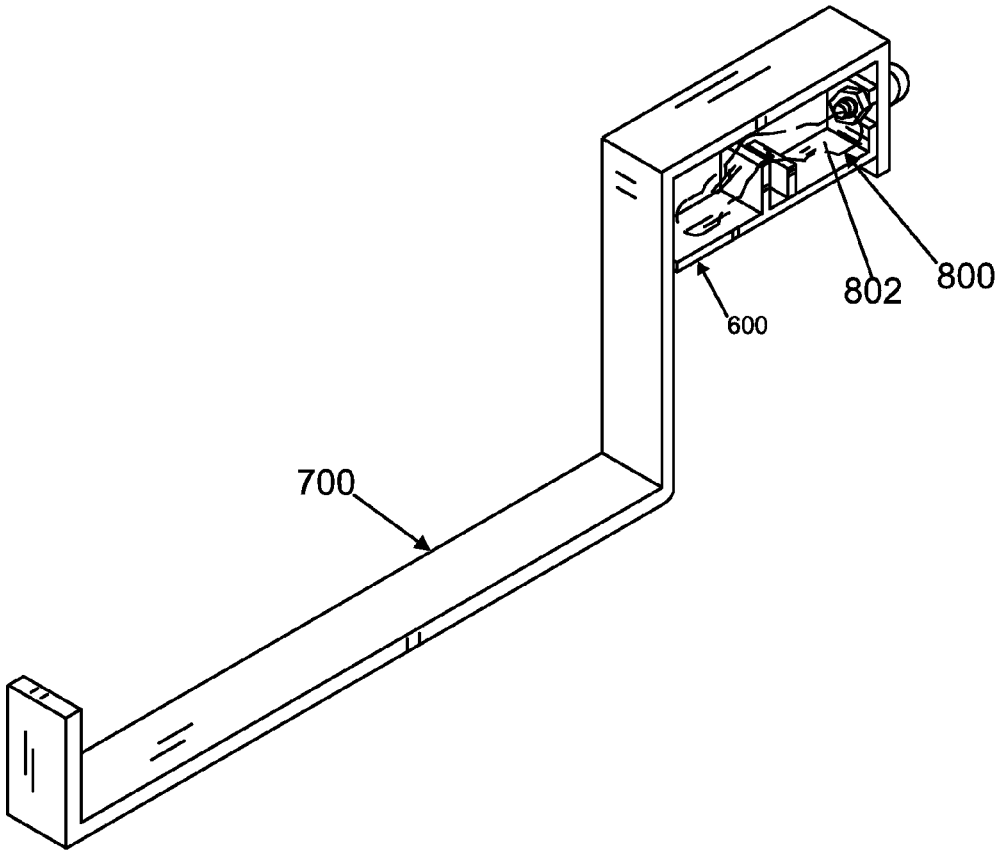
FIG. 15 shows a front, right side, and top perspective view of the fourth bracket along with the fourth device of FIG. 11A, and along with the fourth bolt or screw and the fourth nut, with the fourth bolt or screw and the fourth nut attaching the fourth device of FIG. 11A to the fourth bracket, and with a location of a cross section of the railing shown in FIG. 14.

The device 10 is configured so that the top edges of portions 14 and 16 contact portions of the underside of a railing, similar to as shown in FIG. 15, for a cross section 802 of a railing 800. The device 10 may be configured so that an underside of a railing, such as railing 800 shown in FIGS. 14 and 15, may contact the top of part or portion 12, the top edge of portion 14, the top edge of portion 16, and the top edge of portion 26. In this manner, the device 10 may be used, in at least one embodiment, to secure, attach and stabilize the first bracket 100 to a typically metal railing, such as railing 800. The railing 800 is typically fixed to posts 804 and 806 so that posts 804 and 806 are perpendicular or substantially perpendicular to railing 800. The posts 804 and 806 may be mounted so a ground surface or ground floor such as a ground floor of a deck, wherein the posts 804 and 806 are perpendicular or substantially perpendicular to the ground floor or ground surface.

Figure 4A:
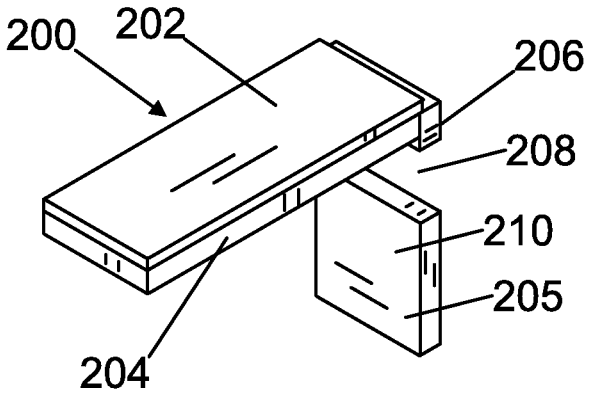
FIG. 4A shows a front, right side, and top perspective view of a second device in accordance with an embodiment of the present invention.
Figure 4B:
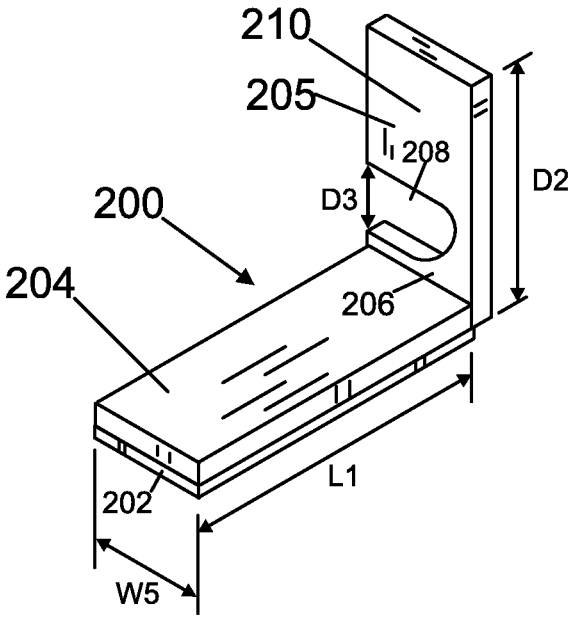
FIG. 4B shows a front, left side, and bottom perspective view of the second device of FIG. 4A.

FIG. 4A shows a front, right side, and top perspective view of a second device 200 in accordance with an embodiment of the present invention. FIG. 4B shows a front, left side, and bottom perspective view of the second device 200. The second device 400 includes portions 202, 204, 206, and 210. The portions 206 and 210 together make up overall portion 205. There is a slot or gap 208 through the portion 205. The portion 205 may be at a ninety degree angle with respect to the portions 204 and 202. The portion 202 may be made of a soft, non abrasive elastic material, so that portion 202 will not scratch a railing, such as a metal railing, such as railing 800 of FIGS. 14 and 15. The other portions of second device 200 may be made of plastic, such as hard plastic. The second device 200 may have the dimensions W5, L1, D2, and D3, which may be about three quarters of an inch, one and seven eighths inches, one and a quarter inches, and a quarter of an inch, respectively.

Figure 5:
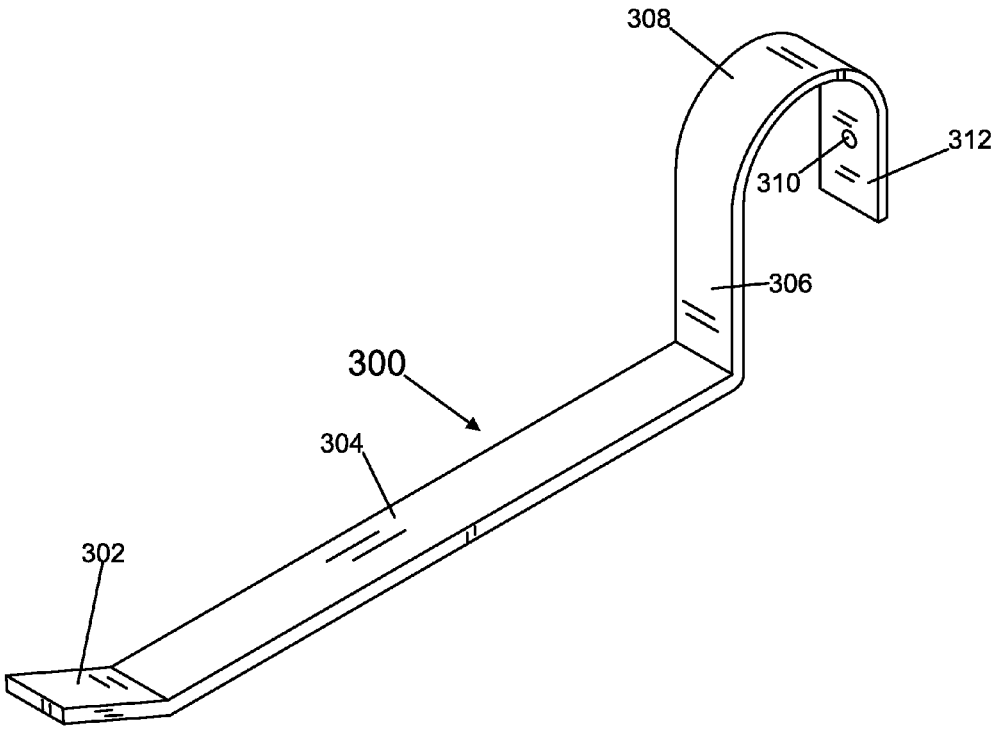
Fig. 5 (Prior Art)
FIG. 5 shows a front, right side, and top perspective view of a second known bracket.

FIG. 5 shows a front, right side, and top perspective view of a second known bracket 300. The second bracket 300 may include portions 302, 304, 306, 308, and 312. The second bracket 300 may have an opening 310. Prior to embodiments of the present invention, the opening 310 would be used to screw the second bracket 300 into a wooden railing.

Figure 6:
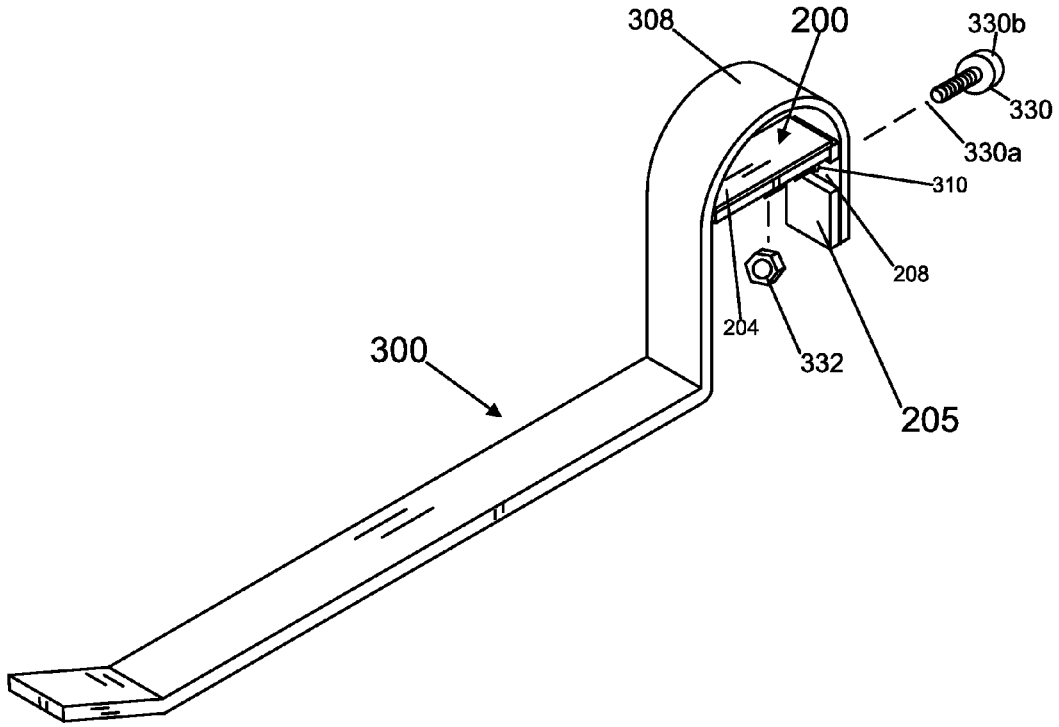
FIG. 6 shows a front, right side, and top perspective view of the second bracket of FIG. 5 along with the second device of FIG. 4A, and along with a second bolt or screw and a second nut, with the second bolt or screw and the second nut not attaching the second device of FIG. 4A to the second bracket.

FIG. 6 shows a front, right side, and top perspective view of the second bracket 300 of FIG. 5 along with the second device 200 of FIG. 4A, and along with a second bolt or screw 330 and a second nut 332, with the second bolt or screw 330 and the second nut 332 not attaching the second device 300 of FIG. 4A to the second bracket 300.

Figure 7:
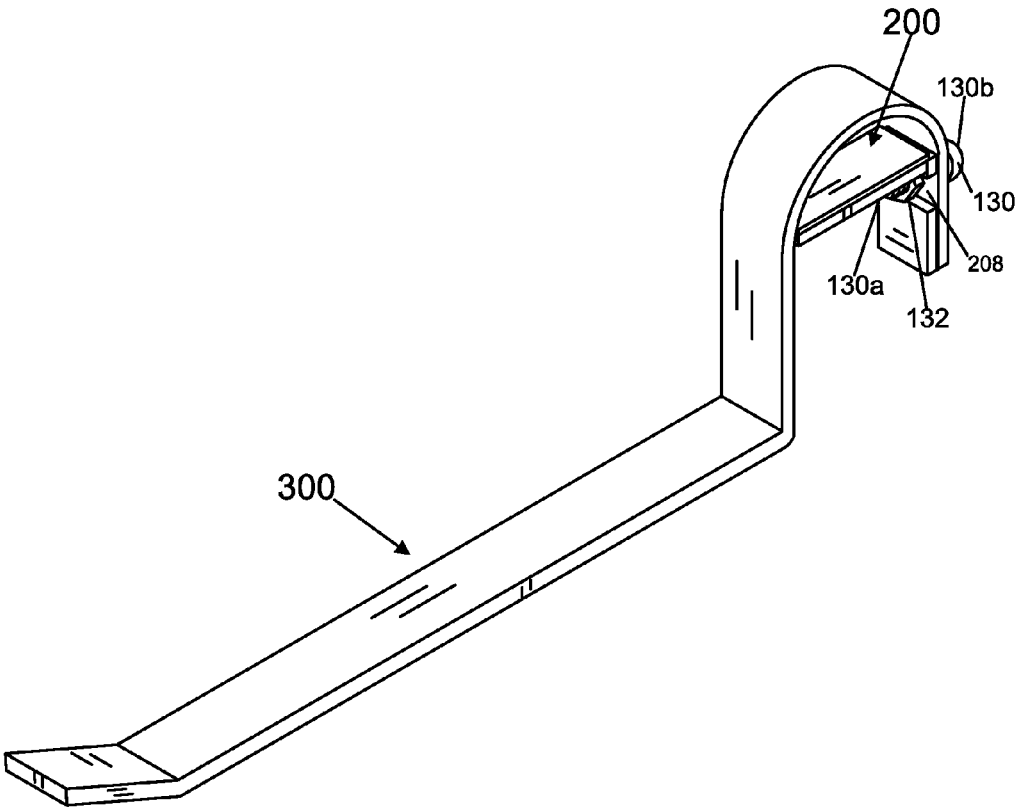
FIG. 7 shows a front, right side, and top perspective view of the second bracket of FIG. 5 along with the second device of FIG. 4A, and along with the second bolt or screw and the second nut, with the second bolt or screw and the second nut attaching the second device of FIG. 4A to the second bracket.

FIG. 7 shows a front, right side, and top perspective view of the second bracket 300 of FIG. 5 along with the second device 200 of FIG. 4A, and along with the second bolt or screw 330 and the second nut 332, with the second bolt or screw 330 and the second nut 332 attaching the second device 200 of FIG. 4A to the second bracket 300.

A railing, such as a metal railing, such as railing 800 shown in FIGS. 14 and 15 may be inserted between portion 308 of bracket 300 and portion 204 of the device 200, similar to as shown by FIGS. 14 and 15. An underside of the railing makes contact with the portion 204. The opening between the portion 308 and the portion 204 in FIG. 6, is configured to be sized so that the railing, such as railing 800 when inserted is held tightly by the combination of the second bracket 300 and the second device 200.

Figure 8A:
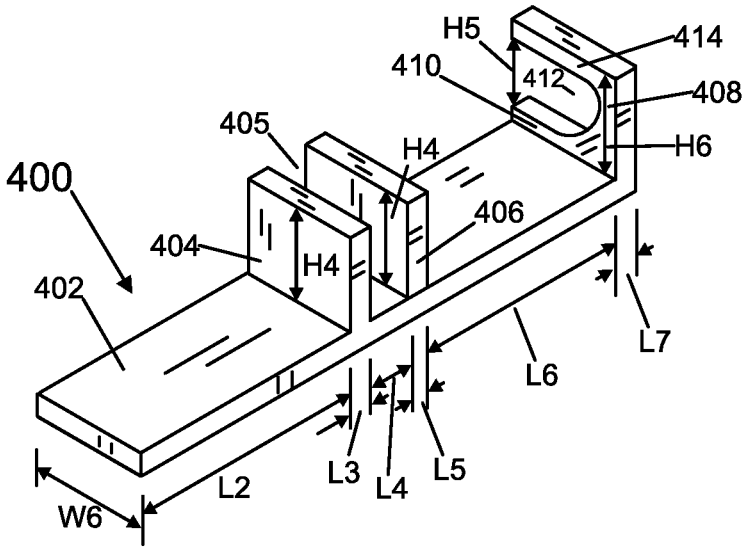
FIG. 8A shows a front, right side, and top perspective view of a third device in accordance with an embodiment of the present invention.
Figure 8B:
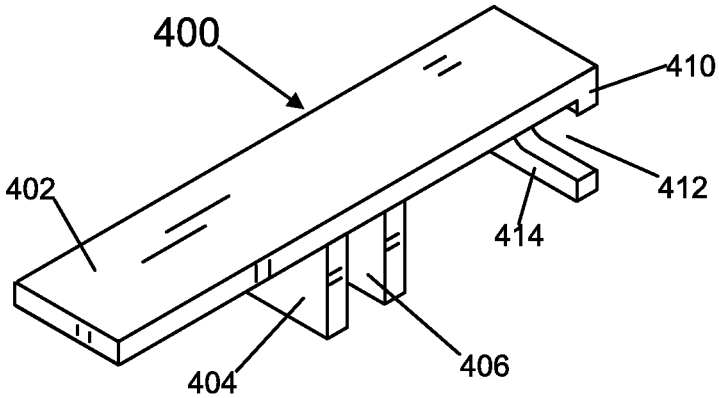
FIG. 8B shows a front, left side, and bottom perspective view of the third device of FIG. 8A.

FIG. 8A shows a front, right side, and top perspective view of a third device 400 in accordance with an embodiment of the present invention. FIG. 8B shows a front, left side, and bottom perspective view of the third device 400. The third device 400 includes portions 402, 404, 406, and 408. The portion 408 further includes portions 410 and 414 and also has a slot 412. The third device 400 may have the dimensions W6, L2, L3, L4, L5, L6, L7, H4, H5, and H6 which may be about one inch, one an five eighths inches, one eighth of an inch, three sixteenths of an inch, one eighth of an inch, one and three eighths inches, one eighth of an inch, nine sixteenths of an inch, one quarter of an inch, and five eighths of an inch, respectively.

Figure 9:
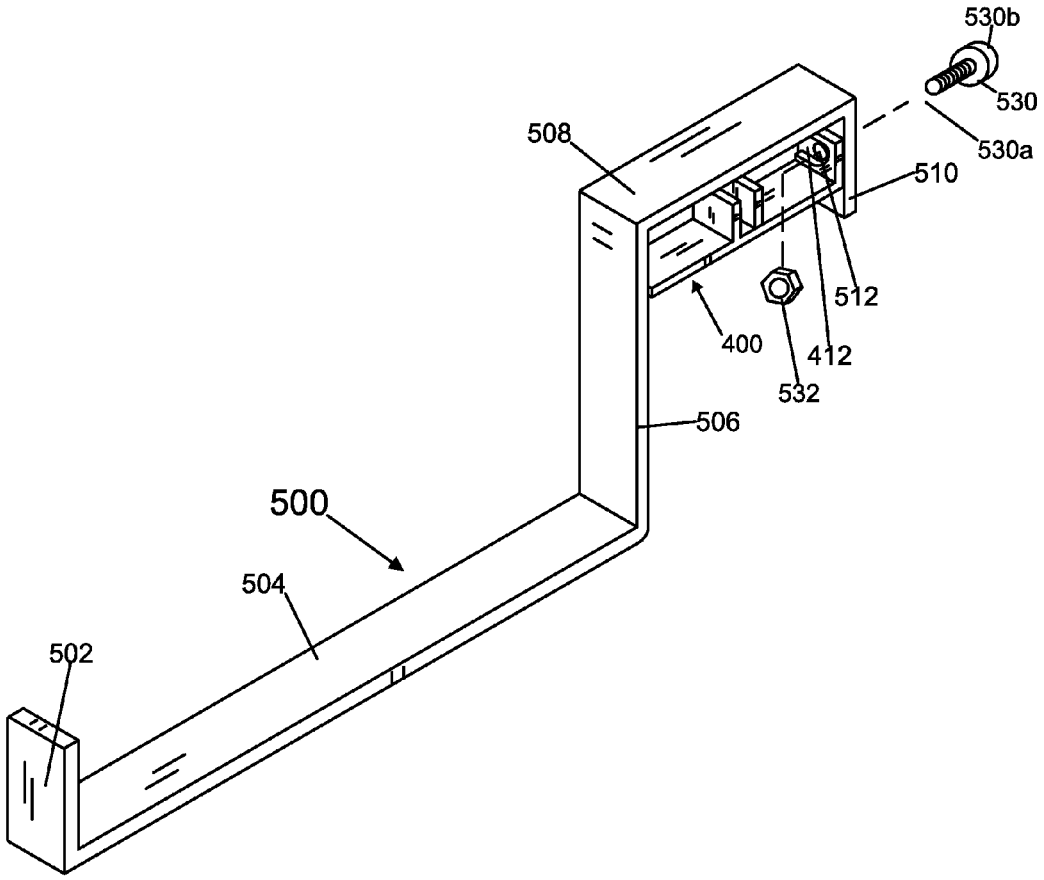
FIG. 9 shows a front, right side, and top perspective view of a third bracket along with the third device of FIG. 8A, and along with a third bolt or screw and a third nut, with the third bolt or screw and the third nut not attaching the third device of FIG. 4A to the third bracket.

FIG. 9 shows a front, right side, and top perspective view of a third bracket 500 along with the third device 400 of FIG. 8A, and along with a third bolt or screw 530 and a third nut 532, with the third bolt or screw 530 and the third nut 532 not attaching the third device 400 of FIG. 8A to the third bracket 500. The third bracket 500 includes portions 502, 504, 506, and 508.

FIG. 10 shows a front, right side, and top perspective view of the third bracket 500 along with the third device 400 of FIG. 8A, and along with the third bolt or screw 530 and the third nut 532, with the third bolt or screw 530 and the third nut 532 attaching the third device 400 of FIG. 8A to the third bracket 500.

A railing, such as a metal railing, such as railing 800 shown in FIGS. 14 and 15 may be inserted between portion 508 of bracket 500 and device 400, similar to as shown by FIGS. 14 and 15. The device 400 is configured, in at least one embodiment, so that an underside of the railing may make contact with portion 402, the top edges of portions 404 and 406, and the top edge of portion 414 to thereby secure and stabilize the bracket 500 attached to a railing, such as railing 800 shown in FIGS. 14 and 15. The opening between the portion 508 and the device 400 in FIG. 10, is configured to be sized so that the railing, such as railing 800 when inserted is held tightly by the combination of the third bracket 500 and the third device 400.

Figure 11A:
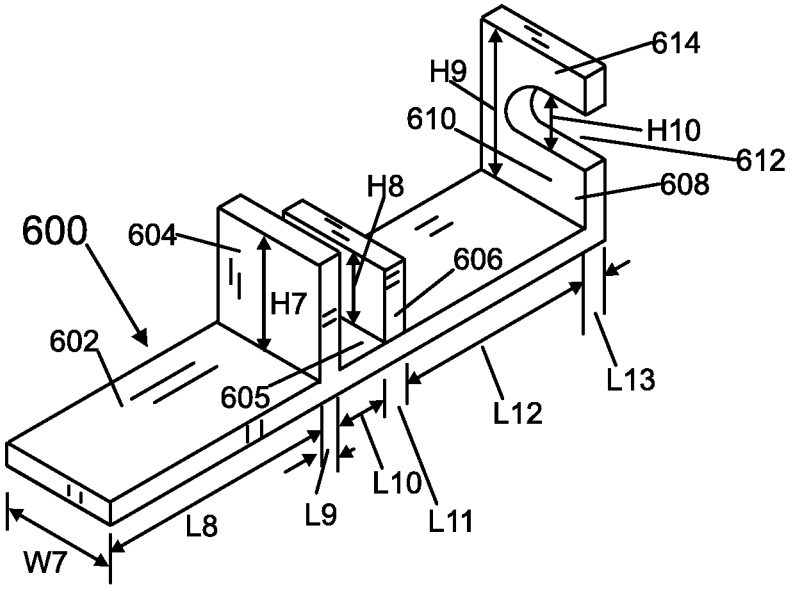
FIG. 11A shows a front, right side, and top perspective view of a fourth device in accordance with an embodiment of the present invention.
Figure 11B:
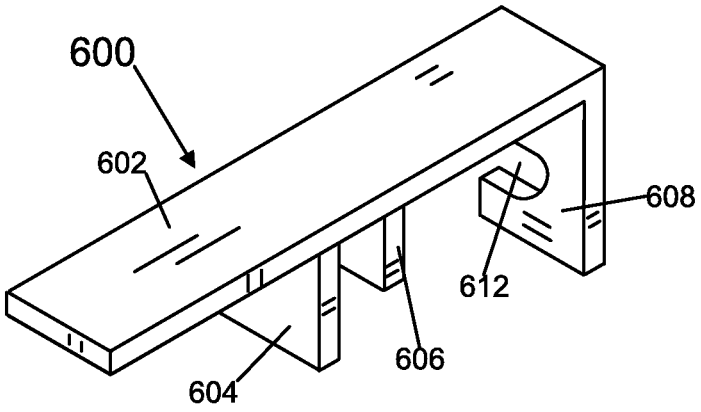
FIG. 11B shows a front, left side, and bottom perspective view of the fourth device of FIG. 11A.

FIG. 11A shows a front, right side, and top perspective view of a fourth device 600 in accordance with an embodiment of the present invention. FIG. 11B shows a front, left side, and bottom perspective view of the fourth device 600. The fourth device 600 includes portions 602, 604, 606, and 608. The portion 608 further includes portions 610 and 614 and also has a slot 612. The fourth device 600 may have the dimensions W7, L8, L9, L10, L11, L12, L13, H7, H8, H9, and H10, which may be about one inch, one and three eighths inches, one eighth of an inch, three eighths of an inch, one eighth of an inch, one and one eighth of an inch, one eight of an inch, five eighths of an inch, three eighths of an inch, one inch, and one quarter of an inch, respectively.

Figure 12:
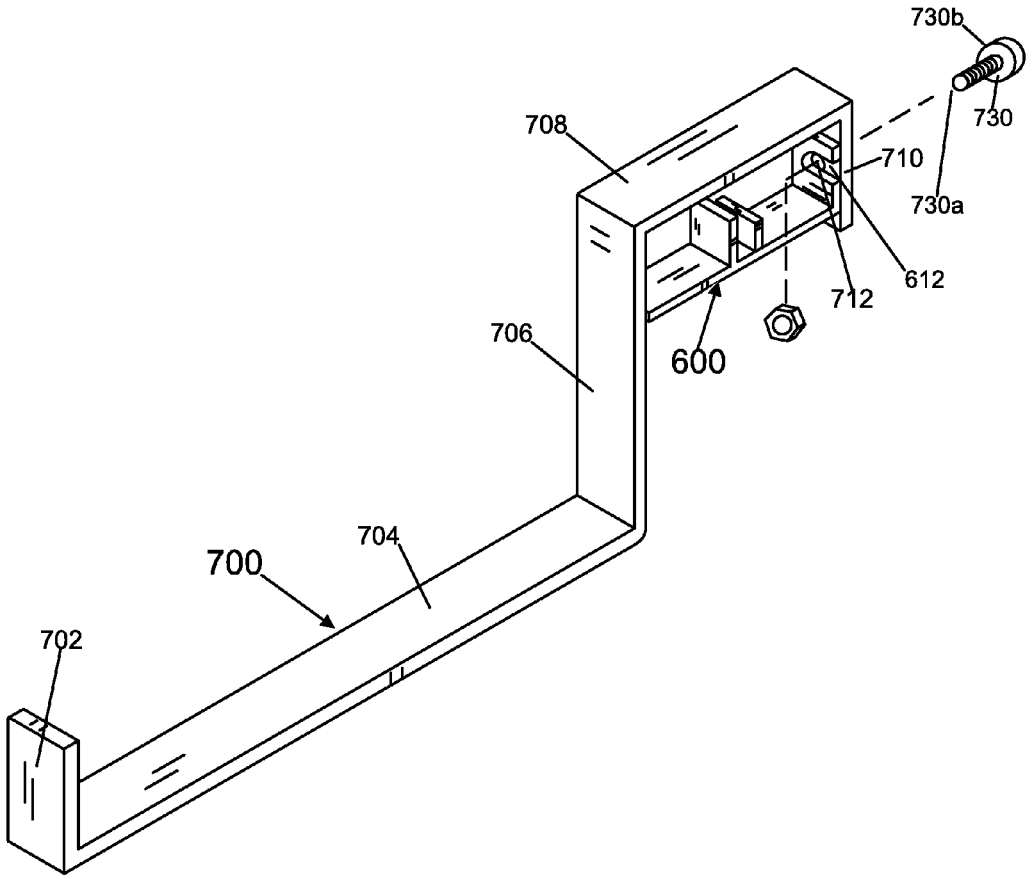
FIG. 12 shows a front, right side, and top perspective view of a fourth bracket along with the fourth device of FIG. 11A, and along with a fourth bolt or screw and a third nut, with the fourth bolt or screw and the fourth nut not attaching the fourth device of FIG. 11A to the fourth bracket.

FIG. 12 shows a front, right side, and top perspective view of a fourth bracket 700 along with the fourth device 600 of FIG. 11A, and along with a fourth bolt or screw 730 and a fourth nut 732, with the fourth bolt or screw 730 and the fourth nut 732 not attaching the fourth device 600 of FIG. 11A to the fourth bracket 700. The fourth bracket 700 includes portions 702, 704, 706, and 708.

Figure 13:
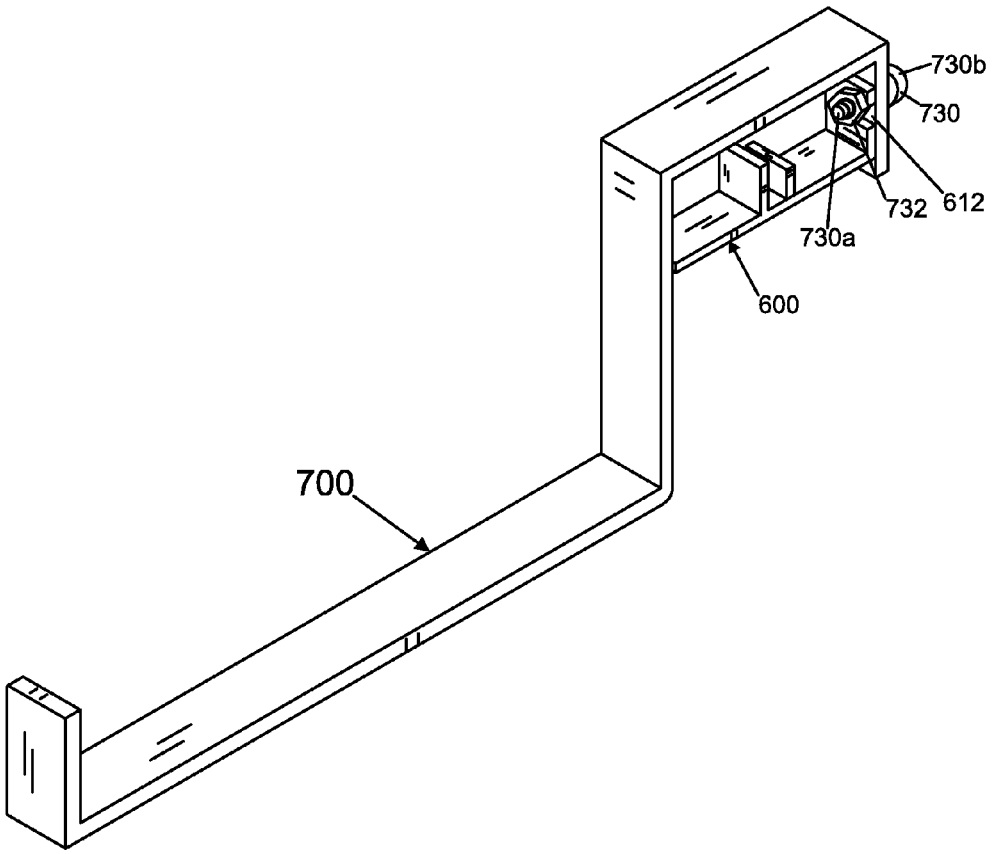
FIG. 13 shows a front, right side, and top perspective view of the fourth bracket along with the fourth device of FIG. 11A, and along with the fourth bolt or screw and the fourth nut, with the fourth bolt or screw and the fourth nut attaching the fourth device of FIG. 11A to the fourth bracket.

FIG. 13 shows a front, right side, and top perspective view of the fourth bracket 700 along with the fourth device 600 of FIG. 11A, and along with the fourth bolt or screw 730 and the fourth nut 732, with the fourth bolt or screw 730 and the fourth nut 732 attaching the fourth device 600 of FIG. 11A to the fourth bracket 700.

A railing, such as a metal railing, such as railing 800 shown in FIGS. 14 and 15 may be inserted between portion 708 of bracket 700 and device 600, as shown by FIGS. 14 and 15. The device 600 is configured, in at least one embodiment, so that an underside 801 of the railing 800, shown in FIG. 14, may make contact with portion 602, the top edges of portions 604 and 606, and the top edge of portion 614 to thereby secure and stabilize the bracket 700 attached to a railing, such as railing 800 shown in FIGS. 14 and 15. The opening between the portion 708 and the device 600 in FIG. 13, is configured to be sized so that the railing, such as railing 800 when inserted is held tightly by the combination of the fourth bracket 700 and the fourth device 600.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a bracket having first and second opposing sections, a connecting section which is substantially perpendicular to the first and second opposing sections and which connects the first and second opposing sections, and an elongated extension portion connected to the first opposing section at a first end of the elongated extension portion, the elongated extension portion having a length and a width, wherein the length of the elongated extension portion is substantially greater than the width, wherein the elongated extension portion extends outwards away from the first opposing section in a direction which is along the length of the elongated extension portion and which is substantially perpendicular to the first opposing section, and substantially parallel to the connecting section; and a device for connecting to the bracket;

wherein the device has a first portion having an opening through which a fastener can be inserted to connect the device to the bracket;

wherein the device has a second portion which is connected to the first portion, so that the second portion is at an angle to the first portion; and wherein the device is sized so that when connected to the bracket by inserting the fastener through the opening, the second portion of the device fits snugly within the first and the second opposing sections of the bracket, such that the second portion has a length which is slightly less than a distance between the first and the second opposing sections of the bracket.

2. The apparatus of claim 1 further comprising a railing situated so that a cross section of the railing sits in between a space between the device and the bracket.

3. The apparatus of claim 2 wherein the device has a third portion which is fixed substantially perpendicularly to the second portion;

wherein an underside of the railing contacts the second portion and the third portion of the device.

4. The apparatus of claim 3 wherein the device has a fourth portion which is fixed substantially perpendicularly to the second portion at a distance from the third portion; and wherein an underside of the railing contacts the second portion, the third portion, and the fourth portion of the device.

5. The apparatus of claim 4 wherein the third portion has a height and the fourth portion has a height, and the height of the third portion differs from the height of the fourth portion.

6. The apparatus of claim 1 wherein the device has a third portion which is fixed substantially perpendicularly to the second portion.

7. The apparatus of claim 6 wherein the device has a fourth portion which is fixed substantially perpendicularly to the second portion at a distance from the third portion.

8. The apparatus of claim 7 wherein the third portion has a height and the fourth portion has a height, and the height of the third portion differs from the height of the fourth portion.

9. The apparatus of claim 1 wherein the bracket is substantially made of metal;

and the device is substantially made of plastic.

10. The apparatus of claim 1 wherein the device has a third portion which is fixed substantially perpendicularly to the second portion;

wherein the device has a fourth portion which is fixed substantially perpendicularly to the second portion at a distance from the third portion;

wherein the third portion has a height and the fourth portion has a height, and the height of the third portion differs from the height of the fourth portion; and wherein the heights of the third and the fourth portions extend out in the same direction from the second portion.

* * * * *